US006113162A

United States Patent [19]

Kobayashi

[11] Patent Number: 6,113,162

[45] **Date of Patent: *Sep. 5, 2000**

[54] DOOR OPEN/CLOSE DETECTOR

[75] Inventor: Fumio Kobayashi, Kanagawa, Japan

[73] Assignee: Ohi Seisakusho Co., Ltd., Yokohama, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 09/172,259

[22] Filed: Oct. 14, 1998

[30] Foreign Application Priority Data

Oct. 14, 1997 [JP] Japan ..... 9-280182

[51] Int. Cl.[7] ..... E05C 3/06

[52] U.S. Cl. ..... 292/216; 292/DIG. 23

[58] Field of Search ..... 292/201, 216, 292/DIG. 23; 200/450

[56] References Cited

U.S. PATENT DOCUMENTS

| | | | |
|---|---|---|---|
| 4,588,217 | 5/1986 | Escaravage | 292/201 |
| 4,762,348 | 8/1988 | Matsumoto | 292/201 |
| 4,814,557 | 3/1989 | Kato | 200/61.64 |
| 4,858,969 | 8/1989 | Lee | 292/78 |
| 4,896,908 | 1/1990 | Kleefeldt | 292/216 |
| 4,911,488 | 3/1990 | Brackmann | 292/216 |
| 4,927,204 | 5/1990 | Asada | 292/216 |
| 4,978,153 | 12/1990 | Hirsch et al. | 292/201 |
| 5,074,603 | 12/1991 | Brackmann | 292/216 |
| 5,522,626 | 6/1996 | Dominique | 292/216 |

*Primary Examiner*—B. Dayoan
*Assistant Examiner*—Gary Estremsky
*Attorney, Agent, or Firm*—Foley & Lardner

[57] ABSTRACT

A door open/close detector is incorporated in a door lock device. The door lock device includes a case, a latch plate pivotally connected to the case to pivot between a latch position to latch a striker and an open position to release the striker, and a lock plate pivotally connected through a shaft to the case to pivot between a lock position to lock the latch plate in the latch position and an unlock position to unlock the latch plate. The door open/close detector includes a switch connected to the case. The switch includes a given surface and a detecting pin. The detecting pin is axially movable in both directions thereby to cause a head thereof to be retractable into and protrusible from the given surface. The detecting pin turns the switch ON and OFF in response to the axial movement thereof. An actuating lever is connected to the lock plate to pivot therewith and has a pin actuating portion. The pin actuating portion is slideable on the give surface while it is pressed against the same thereby to actuate the head of the detecting pin when the lock plate is pivoted about the given shaft between the lock and unlock positions.

9 Claims, 6 Drawing Sheets

DOOR OPEN/CLOSE DETECTOR

BACKGROUND OF THE INVENTION

1. Field of the Invention

The present invention relates in general to door open/close detectors for detecting an open/close condition of a door, and more particularly to the door open/close detectors of a switch type which is installed in an automotive door lock device to detect an open/close condition of an associated door with an aid of the operation of the door lock device.

2. Description of the Prior Art

Hitherto, various types of door open/close detectors have been proposed and put into practical use particularly in the field of motor vehicles. Some are of a switch type installed in a door lock device. Usually, the door lock device comprises a case carried by the door, a latch plate pivotally held in the case and a striker secured to a vehicle body, so that upon closing of the door, the latch plate is pivoted to a full-latch position to latch the striker. With this, the door is latched at a close position. The detector of the switch type comprises a cam portion which is defined by the latch plate and a switch which is fixed to the case and has a detecting pin. When, due to closing or opening of the door, the latch plate is pivoted by the striker, the cam portion of the latch plate directly pushes the detecting pin thereby to turn the switch ON or OFF That is, by sensing movement of the latch plate, the detector makes a judgment as to whether the door has opened or closed.

However, in the conventional detectors of the above-mentioned type, positioning of the switch, more specifically, positioning of the detecting pin relative to the latch plate is very difficult and thus needs a skilled and time-consuming assembling work. In fact, if the positioning is poorly made, the ON/OFF turning of the switch is not precisely carried out in response to the closing or opening of the door.

SUMMARY OF THE INVENTION

It is therefore an object of the present invention to provide a door open/close detector of a switch type, which is free of the above-mentioned drawbacks.

That is, an object of the present invention is to provide a door open/close detector of a switch type incorporated with a door lock device, which can precisely detect the open and close conditions of an associated door even if positioning of parts of the door lock device is not made so precisely.

According to a first aspect of the present invention, there is provided a door open/close detector incorporated with a door lock device. The door lock device includes a case, a latch plate pivotally connected through a first shaft to the case for latching and unlatching a striker, and a lock plate pivotally connected through a second shaft to the case for locking and unlocking the latch plate, the latch plate being pivotal between a latch position to latch the striker and an unlatch position to release the striker, and the lock plate being pivotal between a lock position to lock the latch plate in the latch position and an unlock position to unlock the latch plate. The door open/close detector comprises a switch connected to the case, the switch including a given surface and a detecting pin, the detecting pin being axially movable in both directions thereby to cause a head thereof to be retractable into and protrusible from the given surface, the detecting pin tuning the switch ON and OFF in response to the axial movement thereof; and an actuating lever connected to one of the latch and lock plates to pivot therewith, the actuating lever including a pin actuating portion which is slid on the given surface to actuate the head of the detecting pin when the one of the latch and lock plates is pivoted about the corresponding shaft.

According to a second aspect of the present invention, there is provided a door open/close detector incorporated with a door lock device. The door lock device includes a case, a latch plate pivotally connected to the case to pivot between a latch position to latch a striker and an open position to release the striker, and a lock plate pivotally connected through a given shaft to the case to pivot between a lock position to lock the latch plate in the latch position and an unlock position to unlock the latch plate. The door open/close detector comprises a switch connected to the case, the switch including a given surface and a detecting pin, the detecting pin being axially movable in both directions thereby to cause a head thereof to be retractable into and protrusible from the given surface, the detecting pin turning the switch ON and OFF in response to the axial movement thereof; and an actuating lever connected to the lock plates to pivot therewith, the actuating lever including a pin actuating portion which is slid on the given surface while being pressed against the same thereby to actuate the head of the detecting pin when the lock plates is pivoted about the given shaft between the lock and unlock positions.

BRIEF DESCRIPTION OF THE DRAWINGS

Other objects and advantages of the present invention will become apparent from the following description when taken in conjunction with the accompanying drawings, in which.

DETAILED DESCRIPTION OF THE INVENTION

Figure 1:
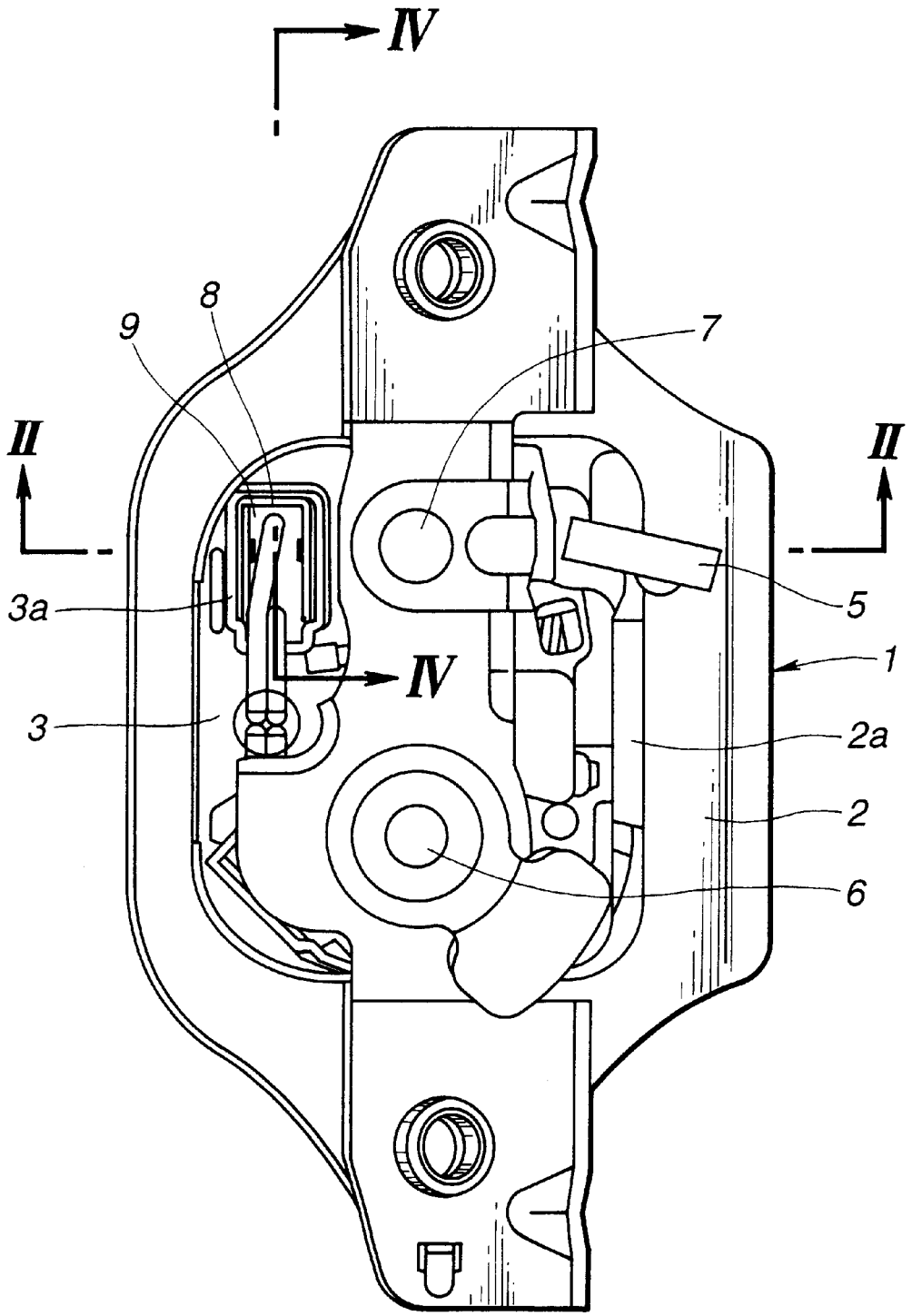
FIG. 1 is a plan view of a door lock device in which a door open/close detector of the present invention is operatively installed.

Referring to the drawings, particularly FIG. 1, there is shown a door lock device 1 in which a door open/close detector of the present invention is operatively installed.

The door lock device 1 shown is of a type suitable for an up-and-down pivotal door, such as a back door of a motor vehicle. That is, the door lock device 1 is mounted in a leading end portion of the back door, and catches a striker (not shown) secured to the vehicle body when the door is pivoted down to its close position.

The door lock device 1 comprises a metal case 2 bolted to the door. The case 2 is formed with a recess 2*a* in which a plastic body 3 is tightly received.

Figure 2:
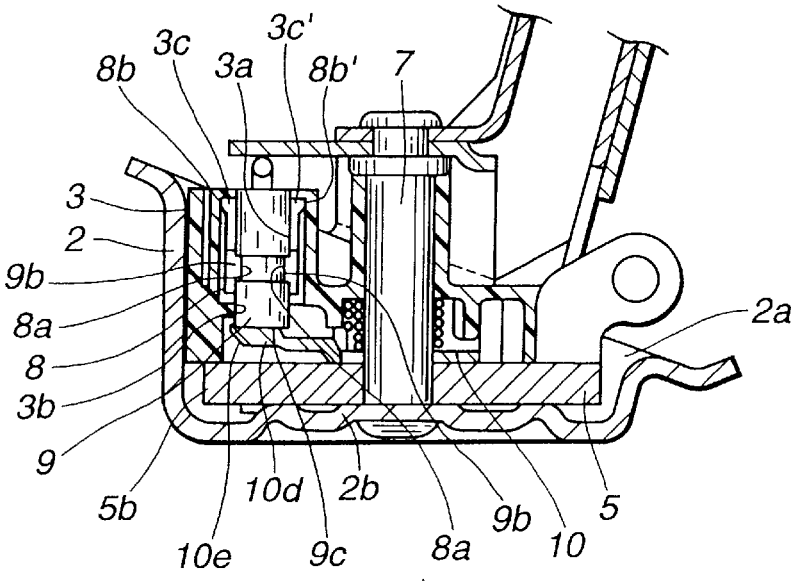
FIG. 2 is a sectional view taken along the line II—II of FIG. 1.

As is understood form FIG. 2, between a bottom 2*b* of the recess 2*a* and the plastic body 3, there is operatively arranged a latching mechanism.

Figure 3:
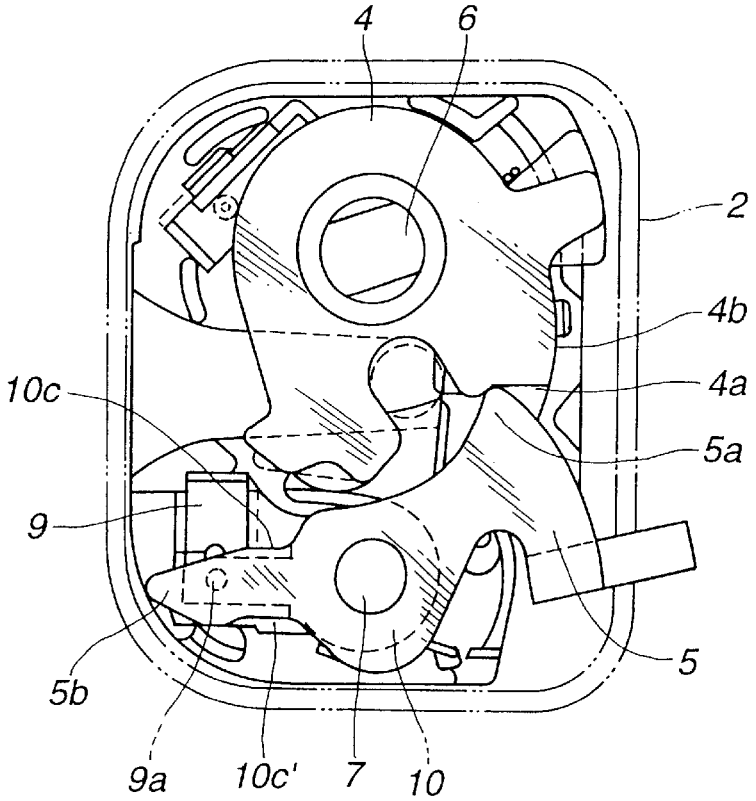
FIG. 3 is a bottom view of the door lock device with a bottom part of a case removed.

As is seen from FIG. 3, the latching mechanism comprises a latch plate 4 pivotally connected to the case 2 through a shaft 6 and a lock plate 5 pivotally connected to the case 2 through a shaft 7. The latch plate 4 catches the striker when the door is pivoted down to assume the close position. Under this condition, the latch plate 4 assumes a full-latch position. The lock plate 5 functions to lock the latch plate 4 at the full-latch position by engaging with a pawl portion 4*a* of the latch plate 4. For this engagement, the lock plate 5 is formed with a projected portion 5*a*. When the lock plate 5 is pivoted clockwise from the illustrated lock position to an unlock position, the projected portion 5*a* is disengaged from the pawl portion 4*a*. With this, the latch plate 4 is permitted to pivot clockwise in FIG. 3 from the full-latch locked position to an open position. This movement is induced upon manipulation of an outside door open handle mounted on the door. That is, when the door open handle is manipulated by an operator standing outside of the vehicle, the lock plate 5 is pivoted in a clockwise direction in FIG. 3, and when thereafter the door is pulled up by the operator, the latch plate 4 is pivoted to the open position with an aid of a force of a biasing spring (not shown). Under this condition, the latch plate 4 releases the striker and thus the door can be freely pivoted up to its full-open position.

When the latch plate 4 is in the open position, the lock plate 5 is kept in the unlock position having the projected portion 5*a* engaged with a peripheral edge 4*b* of the latch plate 4.

As is seen from FIG. 3, the lock plate 5 is formed with an arm portion 5*b* which extends radially outward.

Figure 4:
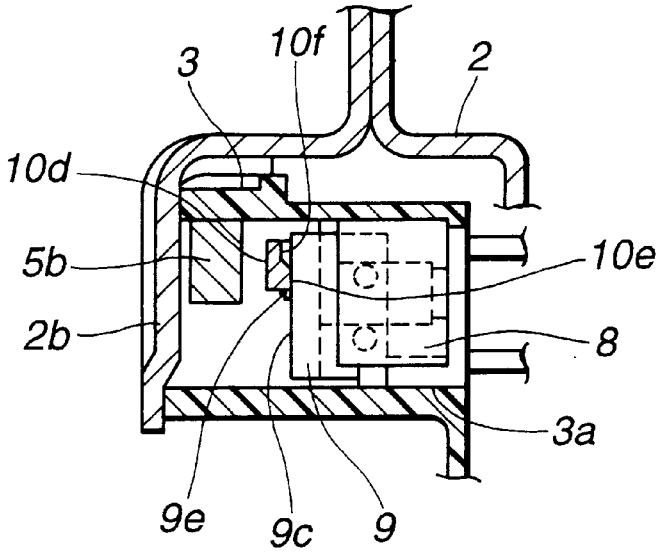
FIG. 4 is a sectional view taken along the line IV—IV of FIG. 1, showing a door open/close detector of the invention.

As is seen from FIGS. 3 and 4, the plastic body 3 is formed at a portion facing the arm portion 5*b*, with a mounting space 3*a* which extends in parallel with the shaft 7. Within the mounting space 3*a*, there is detachably installed a switch 9 through a plastic switch cover 8.

Figure 8:
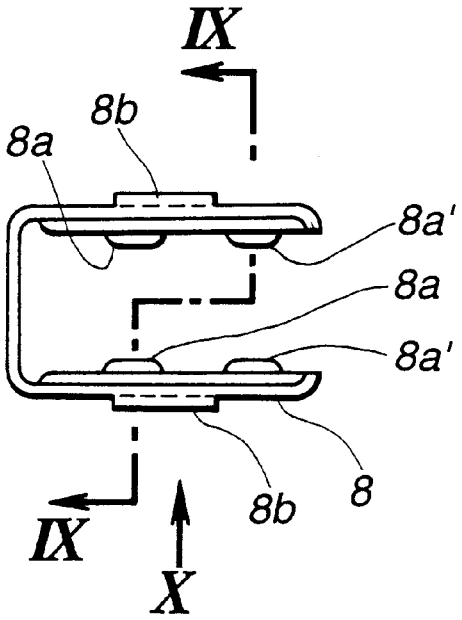
FIG. 8 is a plan view of a switch cover of the door open/close detector of the invention.

As is seen from FIG. 2, the mounting space 3*a* of the plastic body 3 is provided with a pair of pawls 3*c* and 3*c*', and as is seen from FIG. 8, the switch cover 8 if formed with two outward projections 8*b* and 8*b*'. The switch cover 8 has a generally U-shaped structure, as shown. The switch cover 8 is installed in the mounting space 3*a* having the two outward projections 8*b* and 8*b*' resiliently engaged with the pawls 3*c* and 3*c*' in a so-called snap action manner. Thus, the switch cover 8 is tightly but detachably mounted in the mounting space 3*a* of the plastic body 3.

Figure 9:
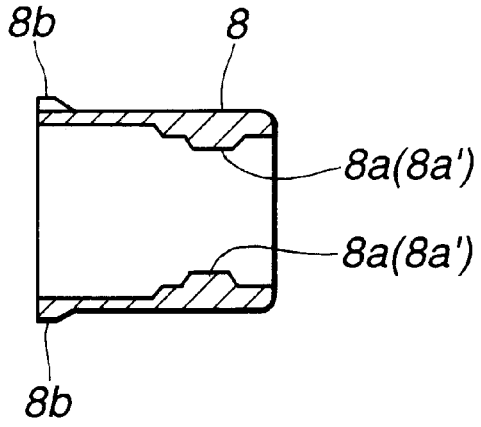
FIG. 9 is a sectional view taken along the line IX—IX of FIG. 8.
Figure 10:
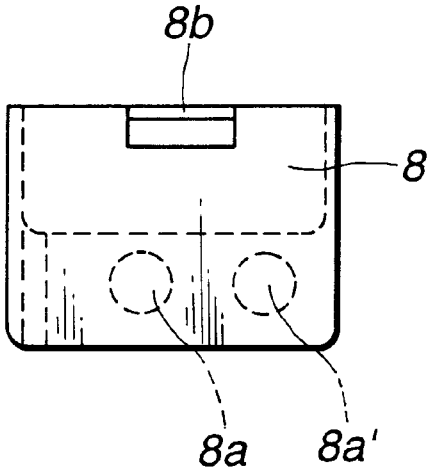
FIG. 10 is a view taken from the direction of an arrow X of FIG. 8.
Figure 11:
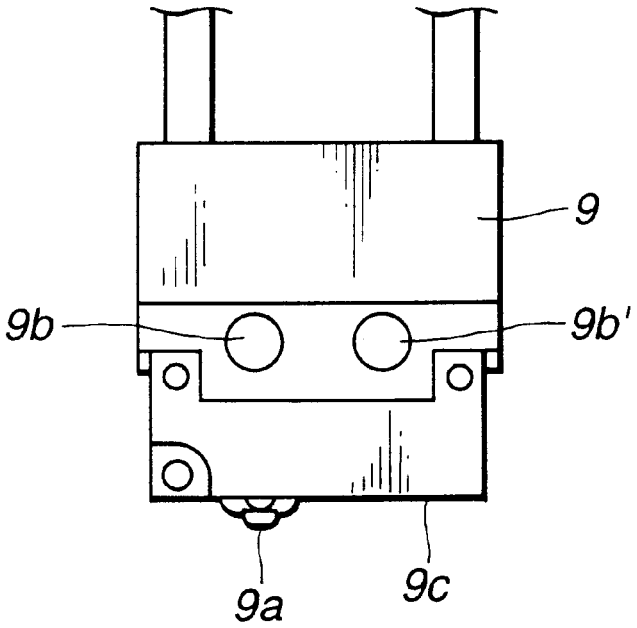
FIG. 11 is a side view of the door open/close detector of the invention.

As is seen from FIG. 11, the switch 9 is formed at each side surface with two circular recesses 9*b* and 9*b*', and as seen from FIGS. 8, 9 and 10, the switch cover 8 is formed at each inner surface with two circular projections 8*a* and 8*a*'. Upon assembly, the two circular projections 8*a* and 8*a*' of the switch cover 8 are resiliently engaged with the circular recesses 9*b* and 9*b*' in a snap action manner. With this, the switch 9 tightly but detachably mounted in the switch cover 8 mounted in the plastic body 3.

As is seen from FIG. 4, the switch 9 is so oriented that a bottom surface 9*c* thereof faces toward the arm portion 5*b* of the lock plate 5.

Figure 5:
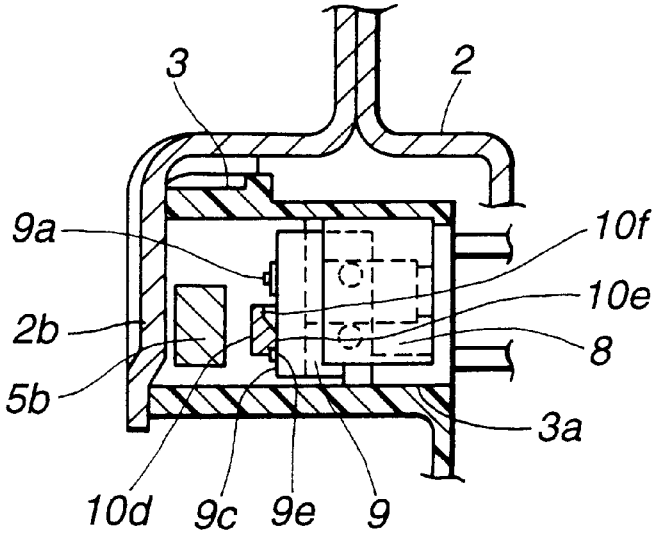
FIG. 5 is a view similar to FIG. 4, but showing a different condition of the door open/close detector of the invention.

As is seen from FIG. 5, to the bottom surface 9*c* of the switch 9, there is arranged a retractable detecting pin 9*a* which constitutes part of the switch 9. That is, as will be described in detail hereafter, when a projected head of the detecting pin 9*a* is pushed into the bottom surface 9*c*, the switch is turned ON, while, the head of the detecting pin 9*a* is projected from the bottom surface 9*c*, the switch 9 is turned OFF. Although not shown in the drawings, a biasing spring is incorporated with the detecting pin 9*a* to bias the same toward a projected position. Thus, usually, the head of the detecting pin 9*a* is kept projected from the bottom surface 9*c* causing the switch 9 to assume OFF condition.

As is seen from FIGS. 2 and 3, an actuating lever 10 is arranged between the lock plate 5 and the plastic body 3, which pivots together with the lock plate 5. The actuating lever 10 is constructed of a resilient plastic, so that it generates a counterforce or biasing force when applied with a certain external force.

As will be described in detail hereinafter, the actuating lever 10 is connected to the lock plate 5 and actuates the retractable detecting pin 9*a* of the switch 9 in response to a pivoting movement of the lock plate 5.

Figure 6:
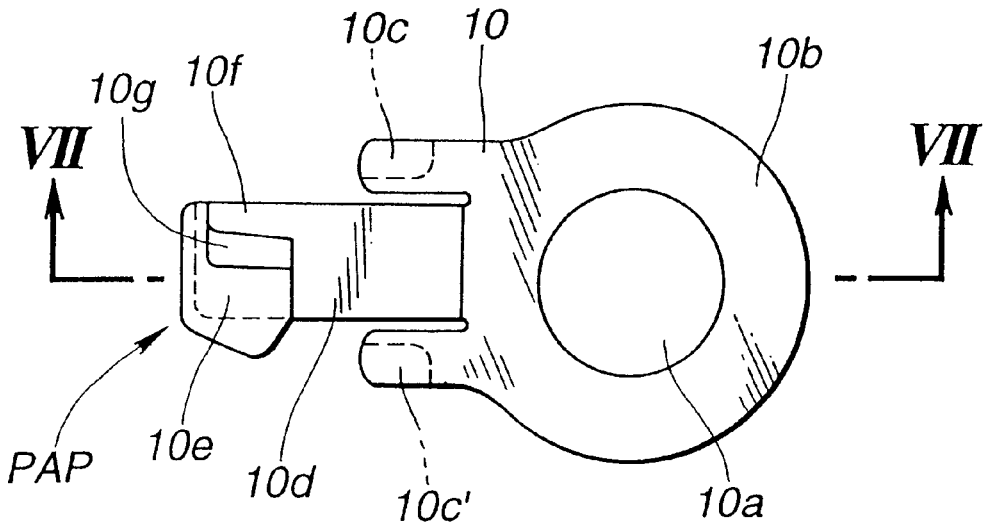
FIG. 6 is a plan view of an actuating lever of the door open/close detector of the invention.
Figure 7:
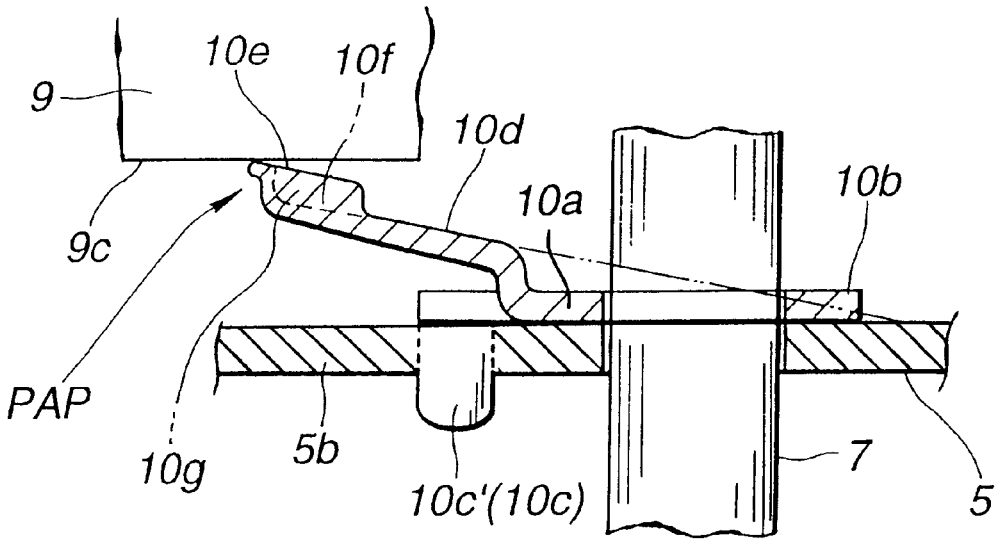
FIG. 7 is a sectional view taken along the line VII—VII of FIG. 6, with some parts surrounding the actuating lever.

As is seen from FIGS. 6 and 7, the actuating lever 10 comprises a circular base portion 10*b* which is formed with a circular opening 10*a* for having the shaft 7 pass therethrough, a pair of bent hook portion 10*c* and 10*c*' which have the arm portion 5*b* of the lock plate 5 snugly put therebetween, and a slanted arm portion 10*d* which extends from the base portion 10*b* along with the arm portion 5*b* of the lock plate 5 toward the bottom surface 9*c* of the switch 9. Thus, the actuating lever 10 pivots about the axis of the shaft 7 together with the lock plate 5 like a single unit.

The slanted arm portion 10*d* of the actuating lever 10 is formed at its leading end with a pin actuating portion "PAP" for actuating the retractable detecting pin 9*a* of the switch 9. The pin actuating portion "PAP" comprises a projected surface 10*e* which is constantly pressed against the bottom surface 9*c* of the switch 9 due to a biasing force produced by the slanted arm portion 10*d*, a depressed surface 10*f* which is depressed as compared with the projected surface 10*e*, and a slanted surface 10*g* which smoothly extends between the projected and depressed surfaces 10*e* and 10*f*. Preferably, the depressed surface 10*f* is shaped concave.

As is seen from FIG. 5, when the lock plate 5 assumes the unlock position, the projected surface 10*e* of the actuating lever 10 is kept away from the detecting pin 9*a* thereby permitting the head of the pin 9*a* to assume the projected position. As is mentioned hereinabove, in this case, the switch 9 assumes OFF condition.

It is to be noted that the unlock position of the lock plate 5 is established when the latch plate 4 releases the striker, that is, when the door is opened.

When the lock plate 5 is pivoted toward the lock position, the projected surface 10*e* of the actuating lever 10 is slid on the bottom surface 9*c* of the switch 9 toward the projected head of the detecting pin 9*a*, and then the slanted surface 10*g* of the actuating lever 10 is brought into engagement with the projected head to gradually push the same into the bottom surface 9*c*. When, as is seen from FIGS. 3 and 4, the lock plate 5 is finally pivoted to the lock position, the projected surface 10*e* fully pushes the head of the detecting pin 9*a* into the bottom surface 9*c* of the switch 9. Upon this, the switch 9 is turned ON.

It is to be noted that the lock position of the lock plate 5 is established when the latch plate 4 fully latches the striker, that is, when the door is closed.

In the following, operation of the door open/close detector will be described with respect to operation of the door lock device 1.

For ease of understanding, the description will be commenced with respect to the open condition of latch plate 4 of the door lock device 1, that is, the condition wherein the door is opened.

Under this condition, the lock plate 5 assumes the unlock position having the projected portion 5*a* kept engaged with the peripheral edge 4*b* of the latch plate 4. It is to be noted that the unlock position of the lock plate 5 is a position (not shown) somewhat displaced in a clockwise direction in FIG. 3 from the lock position of the lock plate 5 illustrated by the solid line.

That is, under the condition, the projected surface 10*e* of the actuating lever 10 is kept away from the projected head of the detecting pin 9*a* causing the switch 9 to assume OFF condition. In other words, the switch 9 detects the open condition of the door.

When the door is pivoted down to assume its close position, the latch plate 4 is pivoted by the striker to the full-latch position and thus the lock plate 5 is pivoted to the lock position as shown in FIG. 3. That is, during this, the latch plate 4 and the lock plate 5 are each pivoted in a counterclockwise direction in FIG. 3. Thus, the projected surface 10*e* of the actuating lever 10 fully pushes the head of the detecting pin 9*a* into the bottom surface 9*c* of the switch 9 causing the switch 9 to assume ON condition. In other words, the switch 9 detects the close condition of the door.

As will be understood from the foregoing description, in the present invention, the projected surface 10*e* (see FIG. 7) of the actuating lever 10 is constantly pressed against the bottom surface 9*c* of the switch 9 due to the biasing force produced by the slanted arm portion 10*d*. This means that even if the positioning between the switch 9 and the lock plate 5 is somewhat poorly made, the resiliency of the slanted arm portion 10*d* compensates the mutual compact between the projected surface 10*e* and the bottom surface 9*c*, so that the ON/OFF operation of the switch 9 induced by the movement of the detecting pin 9*a* is precisely carried out. Due to provision of the paired hook portions 10*c* and 10*c*', the actuating lever 10 can be easily attached to the lock plate 5, which eliminates the need of a skilled and time-consumed assembling work.

Although the above description is directed to the door open/close detector which is associated with the lock plate 5, the present invention can be applied to the latch plate 4 for detecting the open and close conditions of the door. In this case, the detector is so arranged as to turn the switch 9 ON (or OFF) when the latch plate 4 is pivoted to the full-latch position and OFF (or ON) when the latch plate 4 is pivoted to the open position.

It is to be understood that, although the invention has been described with specific reference to a particular embodiment thereof, it is not to be so limited since changes and alternations therein may be made within the full intended scope of this invention as defined by the appended claims.

What is claimed is:

1. In a door lock device including a case, a latch plate pivotally connected through a first shaft to said case for latching and unlatching a striker, and a lock pivotally connected through a second shaft to said case for locking and unlocking said latch plate, said latch plate being pivotable between a latch position to latch said striker and an unlatch position to release said striker, and said lock plate being pivotable between a lock position to lock said latch plate in the latch position and an unlock position to unlock said latch plate, a door open/close detector comprising:

a switch connected to said case, said switch including a given surface and a detecting pin, said detecting pin being axially movable to cause a head thereof to be retractable into and protrusible from said given surface, said detecting pin turning said switch ON and OFF in response to the axial movement thereof; and an actuating lever engaged with one of said latch and lock plates to pivot therewith as a single unit, said actuating lever including a pin actuating portion slideable on the given surface to actuate the head of said detecting pin when said one of said latch and lock plates is pivoted about the corresponding shaft, and wherein said actuating lever is provided with resilient means for producing a biasing force that maintains a constant pressing between said given surface of said switch and said pin actuating portion of said actuating lever.

2. A door open/close detector as claimed in claim 1, said actuating lever further comprises a slanted arm portion by which said pin actuating portion is constantly pressed against said given surface.

3. In a door lock device including a case, a latch plate pivotally connected through a first shaft to said case for latching, and unlatching a striker, and a lock plate pivotally connected through a second shaft to said case for locking and unlocking said latch plate, said latch plate being pivotable between a latch position to latch said striker and an unlatch position to release said striker, and said lock plate being pivotable between a lock position to lock said latch plate in the latch position and an unlock position to unlock said latch plate, a door open/close detector comprising:

a switch connected to said case, said switch including a given surface and a detecting pin, said detecting pin being axially movable to cause a head thereof to be retracted into and protrusible from said given surface, said detecting pin turning said switch ON and OFF in response to the axial movement thereof; and an actuating lever connected to one of said latch and lock plates to pivot therewith, said actuating lever including a pin actuating portion slideable on the given surface to actuate the head of said detecting pin when said one of said latch and lock plates is pivoted about the corresponding shaft in which said actuating lever further comprises a slanted arm portion by which said pin actuating portion is constantly pressed against said given surface, wherein said actuating lever further comprises a pair of hook portion which have a portion of said one of said latch and lock plates snugly put therebetween.

4. A door open/close detector as claimed in claim 3, wherein said actuating lever further comprises a circular base portion which is formed with a circular opening through which the corresponding shaft passes.

5. A door open/close detector as claimed in claim 4, wherein said pin actuating portion comprises:

a projected surface constantly pressed against the given surface due to a biasing force produced by said slanted arm portion;

a depressed surface which is depressed as compared with said projected surface; and a slanted surface smoothly extending between said projected and depressed surfaces.

6. A door open/close detector as claimed in claim 5, wherein said depressed surface is concave in shape.

7. In a door lock device including a case, a latch plate pivotally connected to said case to pivot between a latch position to latch a striker and an open position to release the striker, and a lock plate pivotally connected through a given shaft to said case to pivot between a lock position to lock said latch plate in the latch position and an unlock position to unlock said latch plate, a door open/close detector comprising:

a switch connected to said case, said switch including a given surface and a detecting pin, said detecting pin being axially movable to cause a head thereof to be retractable into and protrusible from said given surface, said detecting pin turning said switch ON and OFF in response to the axial movement thereof; and an actuating lever engaged with said lock plate to pivot therewith as a single unit, said actuating lever including a pin actuating portion slideable on the given surface while being pressed against the same thereby to actuate the head of said detecting pin when said lock plate is pivoted about the give shaft between said lock and unlock positions, and wherein said actuating lever is provided with resilient means for producing a biasing force that maintains a constant pressing between said given surface of said switch and said pin actuating portion of said actuating lever.

8. In a door device including a case, a latch plate pivotally connected to said case to pivot between a latch position to latch a striker and an open position to release the striker, and a lock plate pivotally connected through a given shaft to said case to pivot between a lock position to lock said latch plate in the latch position and an unlock position to unlock said latch plate, a door open/close detector comprising:

a switch connected to said case, said switch including a given surface and a detecting pin, said detecting pin being axially movable to cause a head thereof to be retractable into and protrusible from said given surface, said detecting pin turning said switch ON and OFF in response to the axial movement thereof; and an actuating lever connected to said lock plate to pivot therewith, said actuating lever including a pin actuating portion slideable on the given surface while being pressed against the same thereby to actuate the head of said detecting pin when said lock plate is pivoted about the given shaft between said lock and unlock positions wherein said actuating lever further comprises:

a circular base portion formed with a circular opening through which said given shaft passes;

a pair of hook portions having a portion of said lock plate snugly put therebetween; and a slanted arm portion extending between said circular base portion and said pin actuating portion, said slanted arm portion being so constructed as to produce a counterforce when an external force is applied thereto.

9. A door open/close detector as claimed in claim 8, wherein said pin actuating portion comprises:

a projected surface constantly pressed against the given surface due to the counterforce produced by said slanted arm portion;

a depressed surface which is depressed as compared with said projected surface, said depressed surface being concave in shape; and a slanted surface smoothly extending between said projected and depressed surfaces.

* * * * *